United States Patent [19]

Gardner

[11] Patent Number: 4,839,577

[45] Date of Patent: Jun. 13, 1989

[54] CURRENT-CONTROLLING CIRCUIT

[75] Inventor: Peter A. Gardner, Harestock, England

[73] Assignee: International Business Machines Corporation, Armonk, N.Y.

[21] Appl. No.: 250,648

[22] Filed: Sep. 29, 1988

[30] Foreign Application Priority Data

Oct. 8, 1987 [GB] United Kingdom ..... 8723644

[51] Int. Cl.[4] ..... G05F 3/16

[52] U.S. Cl. ..... 323/316; 307/296.8

[58] Field of Search ..... 323/313–316; 307/296 R, 297

[56] References Cited

U.S. PATENT DOCUMENTS

| | | | |
|---|---|---|---|
| 4,270,081 | 5/1981 | Hareyama | 323/316 |
| 4,361,797 | 11/1982 | Kojima et al. | 323/316 |
| 4,536,702 | 8/1985 | Nagano | 323/316 |
| 4,563,632 | 1/1986 | Palara et al. | 323/316 |
| 4,578,633 | 3/1986 | Aoki | 323/315 |
| 4,727,309 | 2/1988 | Vajdic et al. | 323/315 |

*Primary Examiner*—Patrick R. Salce
*Assistant Examiner*—Emanuel Todd Voeltz
*Attorney, Agent, or Firm*—Stephen J. Limanek

[57] ABSTRACT

A current-controlling circuit for producing either a constant current, independent of supply potential or a current which decreases with increasing supply potential and vice-versa. Three devices are connected together at a point such that the current in the first device and the current in the third device form the current in the second device. The current flowing in the first device is a mirror of the current flowing in a fourth device. When the supply potential increases, the increase in current in the first device at least equals the increase in current in the second device, so that the current in the third device does not increase. If the current in the third device decreases with increasing supply potential, it may be mirrored into subsequent devices which may then pass a constant current. The circuit may include an amplifying current mirror so that any change in current flowing in the first device is an amplified version of the change in current in the fourth device. The circuit may be implemented in field effect transistor technology. The amplitude of the current produced by the circuit is dependent on an input control voltage which is controlled by external means.

17 Claims, 5 Drawing Sheets

CURRENT-CONTROLLING CIRCUIT

TECHNICAL FIELD OF THE INVENTION

This invention relates to a current-controlling circuit and more particularly to a circuit for generating a controlled current from a direct current (dc) voltage supply, the potential of which may be subject to small variations. The invention is particularly suited to implementation in field-effect transistor (FET) technology.

DISCLOSURE OF THE INVENTION

This invention provides a circuit for generating a controlled current from a dc supply which may be subject to voltage variations. The particular devices in the circuit may be selected for example to give a controlled current which reduces in value with increasing supply potential or alternatively is invariant with increasing supply potential.

The controlled current is derived by the circuit as the difference between two other currents, themselves generated from the supply. Each of these other currents varies with variations in the dc supply potential but the extent to which each varies depends on the characteristics of the transistors employed. By judicious selection of device characteristics, in accordance with the present invention, the rate of increase of one current with, i.e., increasing supply potential can be made equal to, greater than or less than the rate of increase of the other current. These currents themselves are generated from the supply, so that the controlled current, generated as the difference between the two other currents, may be made to increase, stay the same or decrease as required. In practice, a current which increases with increasing supply potential is readily obtainable by conventional techniques so the most useful implementations of this invention are in producing a current which either reduces with increasing supply potential or is invariant with increasing supply potential.

Accordingly, the present invention provides a current-controlling circuit for producing a current defined by an input control voltage comprising a dc supply having first and second supply rails defining an electrical potential therebetween, first means connected to the first rail for controlling a first current flowing to or from the first rail, the value of which is determined by the input control voltage, second means connected to the second rail for controlling a second current flowing from or to the second rail, the value of which is also determined by the input control voltage but of a different value to 20 that of the first current, third means connected to the first rail for passing a third current flowing to or from the first rail, wherein the three means are connected to each other such that the first current and the third current sum together to form the second current, the arrangement being such that an increase in the dc supply potential causes an increase in the first current which equals or exceeds any increase caused in the second current, whereby the third current is either unchanged or reduced.

Preferably, an increase in the dc supply potential causes an increase in the value of the first current which equals any increase in the value of the second current, whereby the value of the third current remains constant. This represents the simplest embodiment of the invention.

Alternatively, the third current reduces in response to an increase in dc supply potential and a fourth device, arranged to pass a fourth current, is connected in a mirror arrangement with the third device, this fourth current being invariant with the supply potential by virtue of the fact that the effect on the fourth current of the reduction in the third current is balanced by the effect on the fourth current of the increase in the supply potential. This can provide the benefit that the output current is now this fourth current, which does not represent part of the second current and so may be replicated if required without upsetting the operation of the circuitry controlling the first, second and third currents.

Preferably, the first means comprises first, second and third active devices in combination, with an input connection to the first device for application thereto of the input control voltage, whereby an input current is generated in the first device of a value determined by the input control voltage and the second device is connected to the first device and to the third device so as to mirror the input current into the third device as the first current. This facilitates control of the output current by the control voltage since the control voltage may be connected to a control input of the first active device without any buffering or level translation.

Alternatively, the first means comprises first, second and third active devices and an input connection to the first device for application thereto of the input control voltage and further comprises additional devices, the devices in combination forming a plurality of amplifying current mirrors, whereby an input current is generated in the first device of a value determined by the input control voltage, which input current is amplified by the amplifying current mirrors to form the first current, and whereby a small increase in the input current produces a larger increase in the first current. By this technique the first current is not controlled directly by a single electronic device but is instead dependent on a smaller, input current. Since this input current is smaller, the device controlling it, preferably an FET can have larger physical dimensions. Due to the production variations inherent in the processing of these devices, a larger device can be made more accurately, as a proportion of its nominal size, than a smaller device can. Hence the current passed can be more accurately controlled to its desired value.

The foregoing and other objects, features and advantages of the invention will be apparent from the following more particular description of the preferred embodiments of the invention, as illustrated in the accompanying drawings.

BEST MODE FOR CARRYING OUT THE INVENTION

Figure 1:
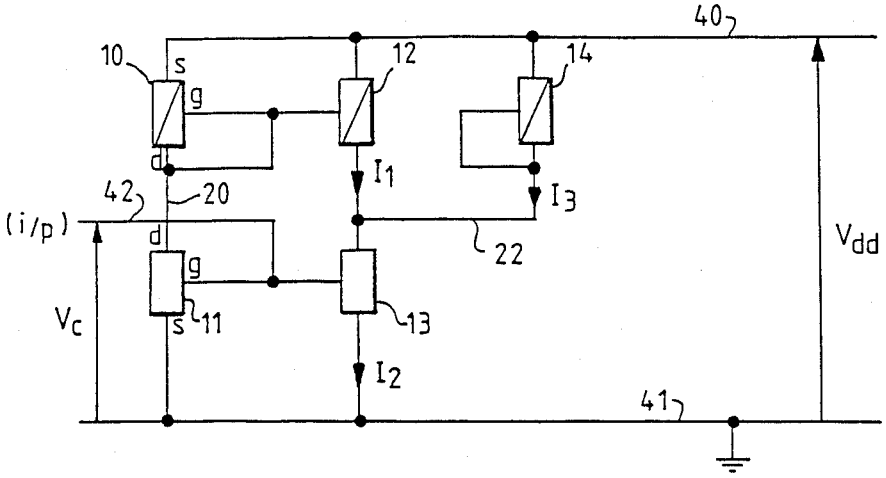
FIG. 1 is a schematic circuit diagram of a first embodiment of the invention.

FIG. 1 shows one simple embodiment of the invention. P-channel field effect transistors (PFETs) 10,12,14 all have their sources connected to the more positive supply rail of a direct current (dc) voltage supply or source Vdd. N-channel field effect transistors (NFETs) 11,13 have their sources connected to the less positive supply rail of the dc supply which for convenience is grounded. Vdd is nominally at a level of 5 volts. FETs 10 and 11 are connected in series, as are FETs 12 and 13. FETs 10 and 12 have a common gate connection, as have FETs 11 and 13. An input terminal i/p is connected to the common gate connection of FETs 11 and 13. FET 14 is connected between the positive supply, as stated, and a node 22 between FETs 12 and 13. PFETs 10 and 14 both have their gates connected to their drains so that each functions effectively as a diode.

Due to the diode effect, the potential at node 20 between FETs 10 and 11 is almost a constant voltage below Vdd. The value of the voltage dropped across PFET 10 depends on the physical characteristics of the device, i.e., its width, length and dopant densities. It should be noted that, in this art, the term "length" refers to the physical distance from the source to the drain and the term "width" refers to he other dimension of the source measured in the plane of the substrate on which the device is formed. Devices generally have a greater width than length. In this instance the physical parameters are selected to give a voltage drop of about 1.5 volts so that node 20 is at roughly 3.5 volts above ground. This potential will vary slightly around this nominal value when the current passed through FETs 10,11 varies. The value of the current passed by NFET 11, and hence series connected PFET 10, is controlled by an input voltage Vc applied to input terminal i/p. As the control voltage is increased, the current Il passed by FETs 10,11 increases. The potential of node 20 is substantially constant but in actuality falls very slightly. The potential of node 22 is likewise controlled primarily by the voltage drop across the equivalent diode provided by PFET 14.

PFETs 10,12,14 are all selected to have near identical physical and electrical characteristics. Consequently, since FETs 10 and 14 are in diode configuration, the potential of node 22 is very close to that of node 20. This similarity in characteristics of the three PFETs is readily achievable since the circuit shown is processed on a single substrate so all three devices will be subject to similar processing variations. If the circuit were to be constructed from discrete devices it would be necessary to ensure device similarity by sampling or other techniques. Since the potential of node 22 is similar to that of node 20 and PFET 12 is pysically similar to PFET 10, the current passed by PFET 12 is similar to that passed by PFET 10.

Figure 2:
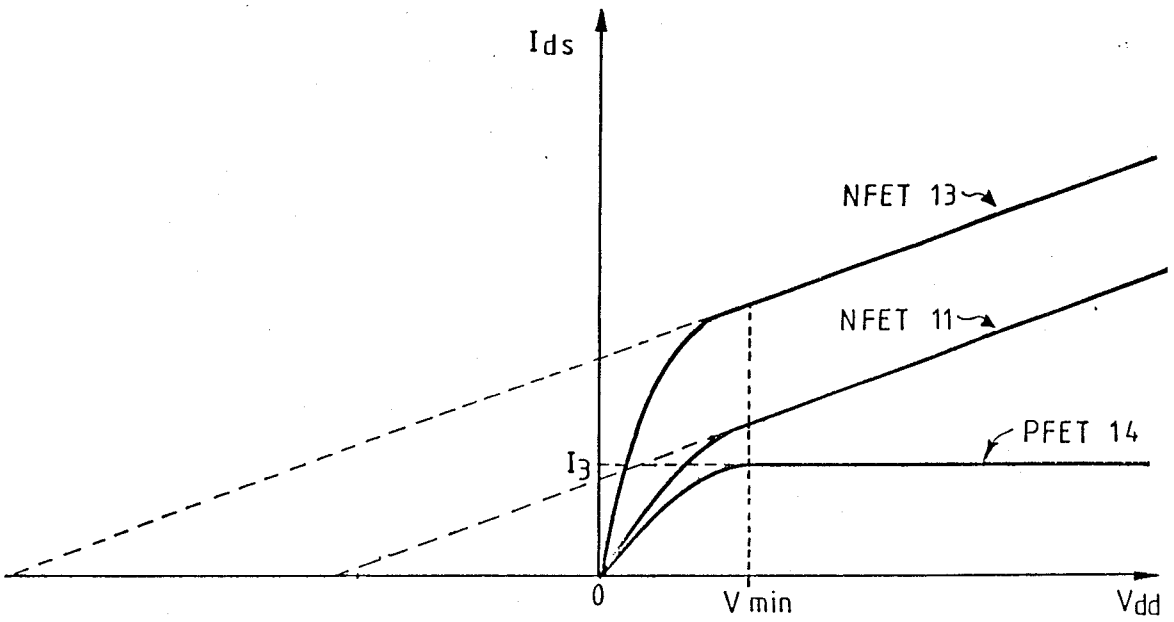
FIG. 2 is a schematic graph showing electrical characteristics of some of the devices in the first embodiment of invention.

The current I2 passed through NFET 13 is determined by its physical and electrical characteristics, its gate-source potential Vgs and its drain-source potential Vds. Its Vgs potential is equal to the Vgs potential of NFET 11, that is the applied control voltage Vc. Its Vds potential is approximately equal to that of NFET 11 since the potentials of nodes 20 and 22 are similar. However NFET 13 is tailored to have significantly different electrical characteristics from NFET 11 by careful selection of its physical dimensions. In this particular embodiment, NFET 13 has a greater width and a greater length than NFET 11 and also NFET 13 has a greater width-to-length ratio. This selection of relative dimensions is such that the characteristics of NFET 11 and NFET 13 are as shown in FIG. 2. In the upper regions of the curves, i.e., in the "saturation regions", the two devices have similar slopes but the curve for NFET 13 is at a substantially higher current level than that of NFET 11. Consequently, as can be seen from FIG. 2, at any value of supply voltage Vdd between Vmin and the voltage at which device breakdown occurs, which is very much higher and consequently not shown, the current I2 taken by NFET 13 exceeds the current I1 taken by NFET 11 by a constant amount. However, it has already been shown that the current passed by NFET 11 is approximately equal to that passed by PFET 12. The difference between the current I2 in NFET 13 and the current I1 in PFET 12 is supplied by PFET 14. In this case, with the linear portion of the device characteristics of NFET 11 and NFET 13 arranged to be parallel, the current I3 supplied by PFET 14 is a constant value (I2−I1), independent of supply voltage variations. The characteristics of PFET 14 in this circuit arrangement are shown in FIG. 2.

This particular embodiment of the invention provides, therefore, an output current I3 in response to an applied control voltage Vc, the value of the current I3 being determined by the value of the control voltage but with the important advantage of being independent of supply voltage variations.

The embodiment described above produces only one controlled current output. In certain instances, however, it may be desirable to have many constant current sources. Further, the current produced by the embodiment above may be difficult to incorporate into a circuit since it must flow into node 22. These two problems are solved by the alternative embodiment of FIG. 3.

Figure 3:
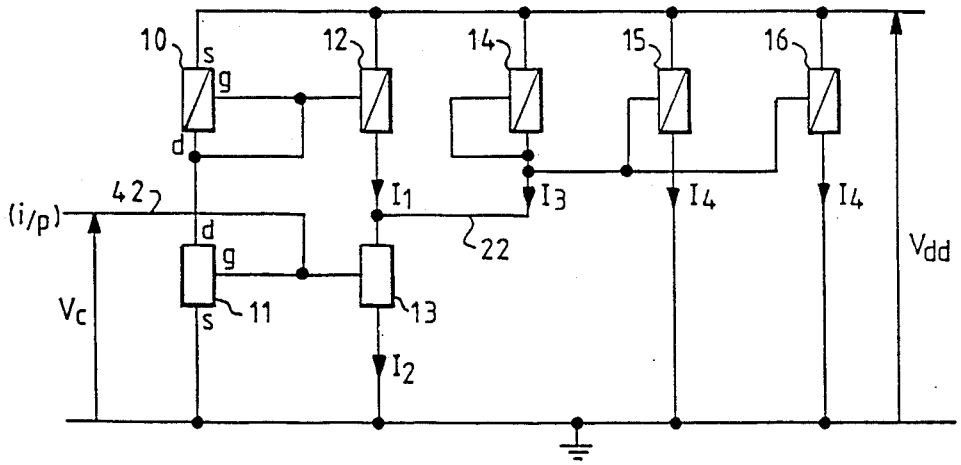
FIG. 3 is a schematic circuit diagram of a second embodiment of the invention, FIG. 4 a schematic graph showing electrical character of some of the devices in the second embodiment of the invention.

In the embodiment of FIG. 3, PFET 14 is not used directly to supply the output current. Instead, additional PFETs 15 and 16 are provided, connected across the supply potential Vdd with their gates connected to node 22 to operate as current mirrors. By this means, the current I3 through PFET 14 is replicated in the outputs of the PFETs 15 and 16. Clearly, this technique may be extended to any number of additional devices, not limited to two, in order to replicate the output current as necessary to suit design requirements.

However, this raises a problem: If the current through PFET 14 remains constant in response to an increase in supply potential, as in the embodiment of FIG. 1, it follows that the potential at node 22 increases by exactly the same extent as the supply potential. Accordingly, the currents passed by PFETs 15 and 16 would increase, since they are subject to an increased source-drain voltage and an unchanged source-gate voltage. Therefore, in order that the conventional current mirroring techniques can be employed to give a constant current through PFETs 15 and 16, it is necessary to modify the circuit so that an increase in supply potential causes a predetermined additional increase in potential at node 22, that is an increase in potential of node 22 over and above that which simply follows any increase in the supply potential. This is achieved by tailoring the circuit so that the current through PFET 14 falls by a controlled amount in response to an increase in supply potential.

Figure 4:
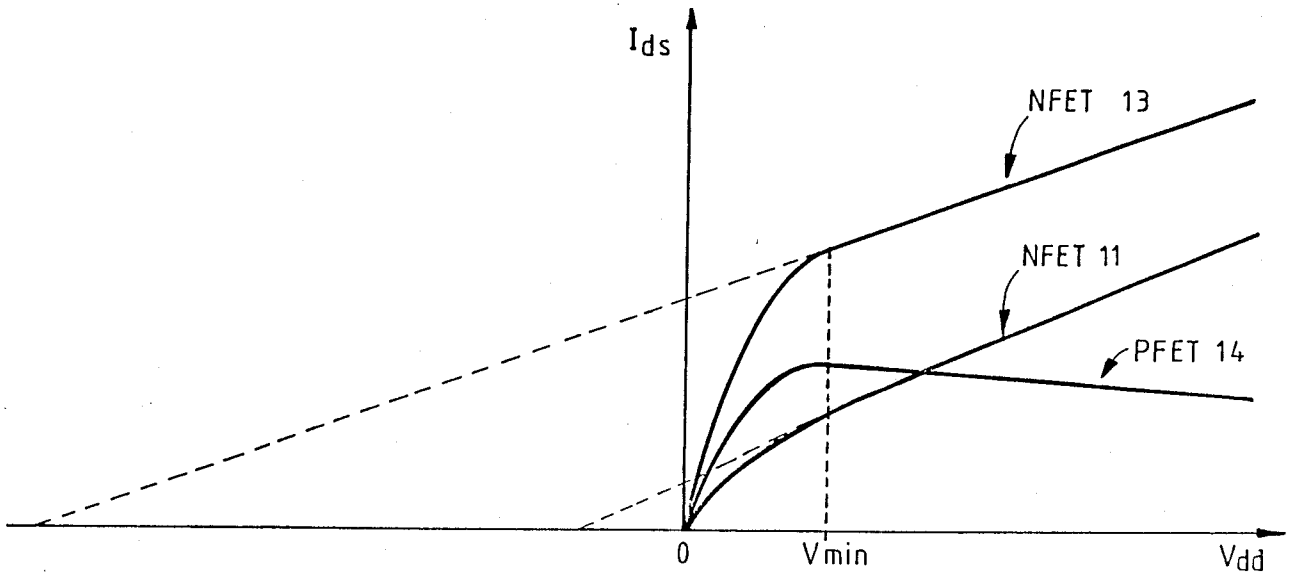

To achieve this, the devices used as NFETs 11 and 13 are processed slightly differently from those in the embodiment of FIG. 1, in order to give the characteristics shown in FIG. 4. This involves fabricating NFET 11 with reduced width and reduced length, causing the slope of the saturation region to be increased to that shown. This in turn produces the characteristic shown for PFET 14 of a falling current with increasing supply potential, since the current in PFET 14 is still constrained to be equal to the current in NFET 13 minus that in PFET 12, i.e., equal to that in NFET 11.

Figure 5:
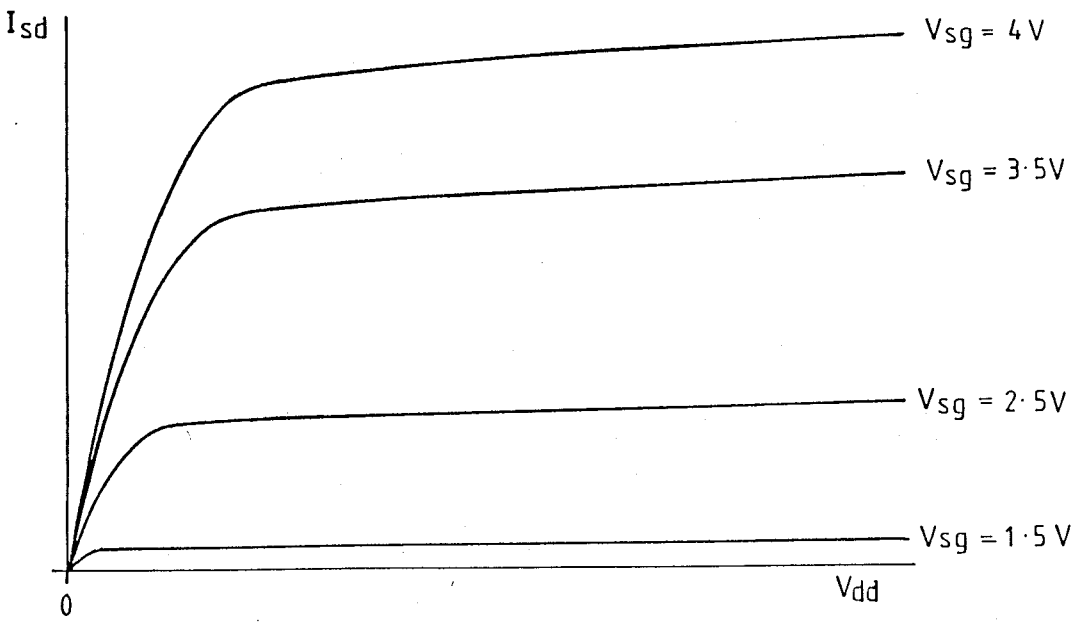
FIG. 5 is a schematic graph showing additional electric characteristic of some of the devices in the second embodiment of the invention, and FIG. 6 schematic circuit diagram of a third embodiment o invention.

Since the current in PFET 14 falls with increasing supply potential, it follows that the source drain voltage of PFET 14 must fall slightly with increasing supply potential, i.e., the potential of node 22 increases slightly in excess of any increase in the supply potential, and, conversely, decreases to a slightly greater degree than any decrease in the supply potential. If the potential of node 22 were to change by exactly the same amount as the supply potential then the currents passed by PFETs 15 and 16 would increase with increasing supply potential due to the increase in their source-drain potentials, as previously mentioned. However, since the potential of node 22 changes by slightly more than the change in the supply potential, the effective resistance of PFETs 15,16 is altered that, as the supply potential increases, their drain currents can be maintained constant as the effect of the rising drain-source voltage is compensated by the falling gate-source voltage. This is further explained by FIG. 5 which shows characteristics of PFET 15 or 16 and in particular shows source-drain current Isd as a function of the supply potential Vdd for four different values of source-gate potential Vsg, i.e., four different values of the potential from the supply to node 22. It can be seen that, with Vsg fixed, an increase in Vdd leads to an increase in Isd; however, if Vsg is reduced slightly as Vdd increases, this can give a constant Isd since, as shown by FIG. 5, Isd reduces with reducing Vsg.

There is still one problem with the embodiment of FIG. 3. To produce a device NFET 11 with characteristics as shown in FIG. 2 or, more particularly FIG. 4, requires a very short length in the device NFET 11, this length being of the order of 1 micron. While it is possible to produce a device with a length in this region, production variations mean that it is difficult to control accurately the length produced. Variations in this length will cause undesirable variations in the device characteristics so that circuits produced would have to be individually sampled to ensure that an acceptable device had been produced. This procedure would be expensive and wasteful.

Figure 6:
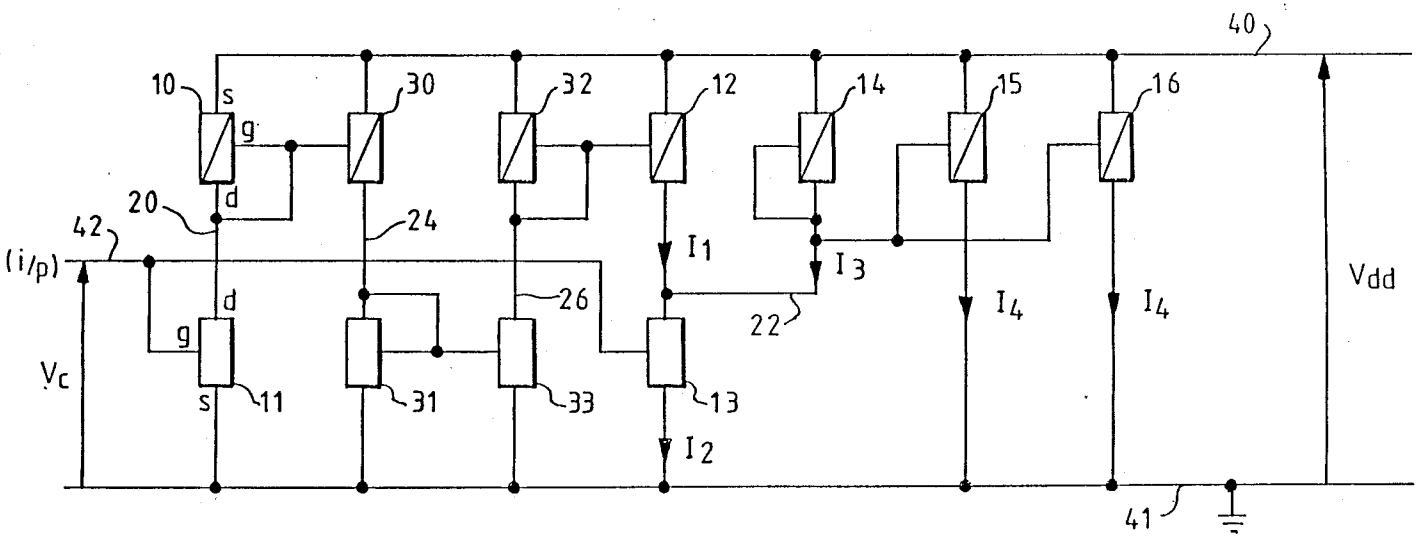

An alternative approach is that shown in FIG. 6. This reproduces the circuit of FIG. 3 and includes further FETs 30–33 which function as amplifying current mirrors as follows:

PFET 10 is arranged in diode configuration, i.e., with the gate connected to the drain, as in the previous embodiments. It, therefore, has a voltage drop from source to drain which is almost independent of current. The device is arranged, by judicious selection of its width, length and dopant densities, to have this voltage drop, roughly 1.5 volts, equal to substantially less than half of the nominal supply potential Vdd of 5 volts. By similar means, the potential across NFET 31, which is also connected in diode configuration, is likewise arranged to be less than half the nominal value of Vdd.

Considering PFETs 10 and 30, they have exactly the same source-gate voltages, determined by the saturation voltage of PFET 10 and equal to less than half Vdd. However, the current in PFET 30 will be greater than that in PFET 10 since the source-drain voltage of PFET 30 is greater than that of PFET 10, since it is more than half Vdd compared to less than half Vdd. If Vdd is now increased, the potential across PFET 10 will not increase significantly but the potential across PFET 30 will increase almost by the increase in Vdd. Consequently, the current in PFET 30 will increase relative to that in PFET 10.

However, the current in PFET 10 will increase since its current is controlled by NFET 11 which has experienced an increase in drain-source voltage. This will cause a small increase in the source-gate voltage of PFET 10 and this increase will be reflected nn PFET 30 since both devices PFET 10 and PFET 30 experience the same source-gate voltage. Combined with the effect mentioned above, the overall effect is that an increase in Vdd causes an increase in current in PFET 10 and NFET 11 and a larger increase in current in PFET 30 and NFET 31. The combination of devices 11,10 with devices 30,31 represents an amplifying current mirror since the current in PFET 10 is amplified and mirrored as the current in PFET 30. Similarly, devices 30,31 with devices 33,32 represent a further amplifying current mirror.

This principle is repeated when the current in PFET 30 and NFET 31 is reflected and amplified by a similar mechanism into NFET 33 and PFET 32. The current in PFET 32 is then reflected into PFET 12 and subsequent operation is as in the embodiment of FIG. 3.

The use of amplifying current mirrors means that the initial current in PFET 11, which affects the operation of the entire circuit, is smaller in magnitude than would otherwise be needed, so PFET 11 may have a greater length and hence be more accurately reproducible.

In the embodiment of FIG. 6, the various devices have the following widths and lengths, in microns:

| Device | Width | Length |
|---|---|---|
| 10 | 12 | 4 |
| 11 | 3.5 | 2.5 |
| 12 | 4 | 1.5 |
| 13 | 32 | 16 |
| 14 | 4 | 1.5 |
| 15 | 5 | 1.5 |
| 16 | 5 | 1.5 |
| 30 | 12 | 4 |
| 31 | 3.5 | 2.5 |
| 32 | 4 | 1.5 |
| 33 | 3.5 | 2.5 |

It can be seen from this table that device 13 is much larger than the others in the circuit, giving it the characteristic shown in FIG. 2.

In each of the embodiments the amplitude of the controlled current is dependent on the value of Vc applied to the gates of devices 11 and 13, since the rate of change of the current in NFET 11 with varying Vc is less than that of NFET 13. However, the way the controlled current varies with Vdd will not be affected by variations in Vc. The mechanism for controlling Vc is not shown but any suitable technique known to those skilled in the art may be employed.

This invention is primarily directed towards producing a current which is dependent on the value of a control voltage Vc but independent of supply potential Vdd. However, it is quite possible, using any of the three embodiments shown, to produce a circuit to give a current which reduces with increasing supply potential by selecting devices with suitable widths, lengths and dopant densities, if such a characteristic is deemed desirable.

Details of design methods for calculating the physical characteristics required for the devices to be employed are not given here but any technique familiar to a person skilled in the art, such as mathematical modelling or simulation, may be used.

While the invention has been particularly shown and described with reference to preferred embodiments thereof, it will be understood by those skilled in the art that various changes in form and details may be made therein without departing from the spirit and scope of the invention.

What is claimed is:

1. A current-controlling circuit for producing a current defined by an input control voltage comprising a direct current voltage supply having first and second supply rails defining an electrical potential therebetween, first means connected to the first rail for controlling a first current flowing to or from said first rail, the value of which is determined by said input control voltage, second means connected to the second rail for controlling a second current flowing from or to said second rail, the value of which is also determined by said input control voltage but of a different value to that of said first current, and third means connected to the first rail for passing a third current flowing to or from said first rail, wherein said first, second and third means are connected to each other such that said first current and said third current sum together to form said second current, the arrangement being such that an increase in potential from said direct current voltage supply causes an increase in said first current which equals or exceeds any increase caused in said second current, whereby said third current is either unchanged or reduced.

2. A current-controlling circuit as set forth in claim 1 wherein an increase in the potential of said direct current voltage supply causes an increase in the value of said first current which equals any increase in the value of said second current, whereby the value of said third current remains constant.

3. A current-controlling circuit as set forth in claim 1 wherein said third current reduces in response to an increase in the potential of said direct current voltage supply and fourth means arranged to pass a fourth current connected in a mirror arrangement with said third means, said fourth current being invariant with the supply potential by virtue of the fact that the effect on said fourth current of the reduction in the third current is balanced by the effect on the fourth current of the increase in the potential of said direct current voltage supply.

4. A current-controlling circuit as set forth in claim 1 wherein said first means includes first, second and third active devices in combination, with an input connection to said first device for application thereto of said input control voltage, whereby an input current is generated in said first device of a value determined by said input control voltage and said second device is connected to said first device and to said third device so as to mirror said input current into said third device as said first current.

5. A current-controlling circuit as set forth in claim 1 wherein said first means includes first, second and third active devices and an input connection to said first device for application thereto of the input control voltage and further comprises additional devices, said additional devices in combination forming a plurality of amplifying current mirrors, whereby an input current is generated in the first device of a value determined by said input control voltage, which input current is amplified by said amplifying current mirrors to form said first current, and whereby a small increase in the input current produces a larger increase in said first current.

6. A current-controlling circuit as set forth in claim 4 wherein said second means includes a fourth active device and said third means includes a fifth active device, said input connection being further connected to said fourth device, whereby said second current is generated in response to application thereto of said input control voltage, the current through said fourth device being formed as the combination of the current through the third device and the fifth device whereby the current through the fifth device is said third current.

7. A current-controlling circuit as set forth in claim 6 wherein said active devices are each provided by an individual field effect transistor and wherein said field effect transistors including said second, third and fifth devices are substantially identical to each other with said fourth device having an active region of greater width than that of said first device.

8. A current-controlling circuit as set forth in claim 7 wherein the active region of said fourth device is longer and has a greater width-to-length ratio than the active region of said first device.

9. A current-controlling circuit comprising first, second and third P-channel field effect transistors, first and second N-channel field effect transistors, an input control voltage terminal, and first and second points of reference potential, said first P-channel field effect transistor and said first N-channel field effect transistor being serially connected between said first and second points of reference potential, said second P-channel field effect transistor and said second N-channel field effect transistor being serially connected between said first and second points of reference potential, said third P-channel field effect transistor being connected between said first point of reference potential and a common point between said second P-channel field effect transistor and said second N-channel field effect transistor, each of said first and third P-channel field effect transistors having its gate connected to its drain, and said input control voltage terminal being connected to a gate of said first N-channel field effect transistor and to a gate of said second N-channel field effect transistor.

10. A current-controlling circuit as set forth in claim 9 further including a fourth P-channel field effect transistor connected between said first and second points of reference potential, and having a gate connected to said common point between said second P-channel transistor and said second N-channel transistors.

11. A current-controlling circuit as set forth in claim 9 wherein said second P-channel transistor has a gate connected to the gate of said first P-channel transistor.

12. A current-controlling circuit as set forth in claim 9 further including a plurality of additional P-channel field effect transistors, each of said plurality of additional transistors being connected between said first and second points of reference potential and each of said plurality of transistors having a gate connected to said common point between said second P-channel transistor and said second N-channel transistor.

13. A current-controlling circuit as set forth in claim 10 wherein said second P-channel transistor has a gate connected to the gate of said first P-channel transistor.

14. A current-controlling circuit as set forth in claim 9 further including an amplifying current mirror disposed between the gate of said first P-channel field effect transistor and the gate of said third P-channel field effect transistor.

15. A current-controlling circuit as set forth in claim 14 wherein said amplifying current mirror includes fourth and fifth P-channel field effect transistors and third and fourth N-channel field effect transistors, said fourth P-channel transistor and said third N-channel transistor being serially connected between said first and second points of reference potential, a gate of said fourth P-channel transistor being connected to the gate of said first P-channel transistor and a gate of said third N-channel transistor being connected to a common point between said fourth P-channel transistor and said third N-channel transistor, said fifth P-channel transistor and said fourth N-channel transistor being serially connected between said first and second points of reference potential, a gate of said fifth P-channel transistor being connected to the gate of said second P-channel transistor and to a common point between said fifth P-channel transistor and said fourth N-channel transistor, and a gate of said fourth N-channel transistor being connected to the gate of said third N-channel transistor.

16. A current-controlling circuit comprising a direct current voltage source having a first rail at a given potential and a second rail at a potential more positive than that of said first rail, an input control voltage terminal, a first P-channel transistor, a first N-channel transistor connected in series with said first P-channel transistor between said first and second rails, a gate of said first P-channel transistor being connected to a common point between said first P-channel transistor and said first N-channel transistor and a gate of said first N-channel transistor being connected to said input control voltage terminal, a second P-channel transistor, a second N-channel transistor connected in series with said second P-channel transistor between said first and second rails, a gate of said second P-channel transistor being connected to the gate of said first P-channel transistor and a gate of said second N-channel transistor being connected to a common point between said second P-channel transistor and said second N-channel transistor, a third P-channel transistor, a third N-channel transistor connected in series with said third P-channel transistor between said first and second rails, a gate of said third P-channel transistor being connected to the common point between said third P-channel transistor and said third N-channel transistor and a gate of said third N-channel transistor being connected to the gate of said second N-channel transistor, a fourth P-channel transistor, a fourth N-channel transistor connected in . series with said fourth P-channel transistor between said first and second rails, a gate of said fourth P-channel transistor being connected to the gate of said third P-channel transistor and a gate of said fourth N-channel transistor being connected to said input control voltage terminal, a fifth P-channel transistor connected between said second rail and the common point between said fourth P-channel transistor and said fourth N-channel transistor, a gate of said fifth P-channel transistor being connected to the common point between said fourth P-channel transistor and said fourth N-channel transistor, and a sixth P-channel transistor connected between said first and second rails, a gate of said sixth P-channel transistor being connected to the gate of said fifth P-channel transistor.

17. A current-controlling circuit as set fourth in claim 16 wherein each of said transistors has a width significantly longer than that of its length.

* * * * *